US007581945B2

(12) United States Patent
Widmer et al.

(10) Patent No.: US 7,581,945 B2
(45) Date of Patent: Sep. 1, 2009

(54) SYSTEM, METHOD, AND ARTICLE OF MANUFACTURE FOR ADJUSTING CO EMISSION LEVELS AT PREDETERMINED LOCATIONS IN A BOILER SYSTEM

(75) Inventors: Neil Colin Widmer, San Clemente, CA (US); Avinash Vinayak Taware, Niskayuna, NY (US); Ivy Wai Man Chong, Glenmont, NY (US)

(73) Assignee: General Electric Company, Schenectady, NY (US)

( * ) Notice: Subject to any disclaimer, the term of this patent is extended or adjusted under 35 U.S.C. 154(b) by 510 days.

(21) Appl. No.: 11/290,754

(22) Filed: Nov. 30, 2005

(65) Prior Publication Data

US 2007/0122757 A1 May 31, 2007

(51) Int. Cl.
*F23N 5/00* (2006.01)
*F23B 7/00* (2006.01)

(52) U.S. Cl. ..... 431/12; 431/173; 431/281; 431/76; 431/90; 110/345; 110/185; 110/192; 700/274; 700/54; 700/30; 700/17; 700/20; 702/182; 702/132

(58) Field of Classification Search ..... 431/12, 431/76, 90, 173, 281; 110/347, 185–192; 700/274, 54, 30, 17, 20; 702/182, 132
See application file for complete search history.

(56) References Cited

U.S. PATENT DOCUMENTS

| | | | | |
|---|---|---|---|---|
| 3,369,749 | A | 2/1968 | Siegmund et al. | |
| 4,488,516 | A | 12/1984 | Bueters et al. | |
| 4,887,958 | A | 12/1989 | Hagar et al. | |
| 4,927,351 | A | 5/1990 | Hagar et al. | |
| 4,996,951 | A | 3/1991 | Archer et al. | |
| 6,164,221 | A | 12/2000 | Facchiano et al. | |
| 6,361,310 | B1 * | 3/2002 | Fastnacht et al. | 431/12 |
| 6,429,019 | B1 * | 8/2002 | Goldstein et al. | 436/134 |
| 6,745,708 | B2 * | 6/2004 | Slater et al. | 110/348 |
| 7,010,461 | B2 * | 3/2006 | Draxton et al. | 702/182 |
| 7,277,777 | B2 * | 10/2007 | Draxton et al. | 700/274 |
| 2004/0191914 | A1 * | 9/2004 | Widmer et al. | 436/55 |

FOREIGN PATENT DOCUMENTS

| | | |
|---|---|---|
| EP | 1705462 | 9/2006 |
| GB | 2411007 | 8/2005 |

(Continued)

OTHER PUBLICATIONS

European Search Report, Application No. EP06124970, dated Oct. 10, 2007.

(Continued)

*Primary Examiner*—Steven B McAllister
*Assistant Examiner*—Nikhil Mashruwala
(74) *Attorney, Agent, or Firm*—Cantor Colburn, LLP

(57) ABSTRACT

A system, a method, and an article of manufacture for adjusting CO emission levels in predetermined locations in a boiler system are provided. The boiler system has a plurality of burners and a plurality of CO sensors disposed therein. The system determines locations within the boiler system that have relatively high CO levels utilizing the plurality of CO sensors and then adjusts A/F ratios of burners affecting those locations to decrease the CO levels at the locations.

14 Claims, 6 Drawing Sheets

FOREIGN PATENT DOCUMENTS

WO WO9939137 8/1999

OTHER PUBLICATIONS

European Search Report, Application No. EP06124971 dated Oct. 10, 2007.

European Search Report, Application No. EP06125034, dated Oct. 10, 2007.

European Search Report, Application No. EP06124970, dated Sep. 7, 2007.

European Search Report, Application No. EP06124971 dated Aug. 21, 2007.

European Search Report, Application No. EP06125034, dated Sep. 7, 2007.

* cited by examiner

SYSTEM, METHOD, AND ARTICLE OF MANUFACTURE FOR ADJUSTING CO EMISSION LEVELS AT PREDETERMINED LOCATIONS IN A BOILER SYSTEM

CROSS REFERENCE TO RELATED APPLICATIONS

This application is related to the following United States Patent Applications filed contemporaneously herewith: SYSTEM AND METHOD FOR DECREASING A RATE OF SLAG FORMATION AT PREDETERMINED LOCATIONS IN A BOILER SYSTEM, Ser. No. 11/290,759; and SYSTEM, METHOD, AND ARTICLE OF MANUFACTURE FOR ADJUSTING TEMPERATURE LEVELS AT PREDETERMINED LOCATIONS IN A BOILER SYSTEM, Ser. No. 11/290,244 which are incorporated by reference herein in their entirety.

BACKGROUND OF THE INVENTION

Fossil-fuel fired boiler systems have been utilized for generating electricity. One type of fossil-fuel fired boiler system combusts an air/coal mixture to generate heat energy that increases a temperature of water to produce steam. The steam is utilized to drive a turbine generator that outputs electrical power.

A by-product of combusting an oxygen and a hydrocarbon-based fuel mixture, such an air/coal mixture, is carbon monoxide (CO). One objective of a control system controlling operation of a coal fired boiler system is to maintain total CO levels exiting a boiler system below a threshold level. The inventors herein have recognized that CO levels at particular locations in the boiler system can have CO levels greater than a threshold CO level while other locations have CO levels less than the threshold CO level. Further, the variance of CO levels in the boiler system can result in increased total CO emissions and local CO concentrations above the threshold level.

Accordingly, the inventors herein have recognized a need for an improved system and method for controlling a boiler system that can determine locations within the boiler system that have relatively high CO levels and that can adjust an air-fuel (A/F) ratio of burners affecting those locations to decrease CO levels therein.

BRIEF DESCRIPTION OF THE INVENTION

A method for adjusting CO emission levels within a boiler system in accordance with an exemplary embodiment is provided. The boiler system has a first plurality of burners and a plurality of CO sensors disposed therein. The method includes receiving a plurality of signals from the plurality of CO sensors disposed at a first plurality of locations in the boiler system. The method further includes determining a plurality of CO levels at the first plurality of locations based on the plurality of signals. The method further includes determining a second plurality of locations that have CO levels greater than or equal to a threshold CO level. The second plurality of locations is a subset of the first plurality of locations. The method further includes determining a second plurality of burners in the boiler system that are contributing to the second plurality of locations having CO levels greater than or equal to the threshold CO level. The second plurality of burners is a subset of the first plurality of burners. The method further includes determining an amount of CO being generated by each burner of the first plurality of burners for each location of the second plurality of locations. The method further includes increasing an A/F ratio of at least one burner of the second plurality of burners to increase A/F ratios at the second plurality of locations in order to decrease the CO levels at the second plurality of locations toward the threshold CO level, based on the amount of CO being generated by the at least one burner of the second plurality of burners.

A control system for adjusting CO emission levels within a boiler system in accordance with another exemplary embodiment is provided. The boiler system has a first plurality of burners. The control system includes a plurality of CO sensors disposed at a first plurality of locations in the boiler system. The plurality of CO sensors are configured to generate a plurality of signals indicative of CO levels at the first plurality of locations. The control system further includes a controller operably coupled to the plurality of CO sensors. The controller is configured to receive the plurality of signals and to determine a plurality of CO levels at the first plurality of locations based on the plurality of signals. The controller is further configured to determine a second plurality of locations that have CO levels greater than or equal to a threshold CO level. The second plurality of locations are a subset of the first plurality of locations. The controller is further configured to determine a second plurality of burners in the boiler system that are contributing to the second plurality of locations having CO levels greater than or equal to the threshold CO level. The second plurality of burners is a subset of the first plurality of burners. The controller is further configured to determine an amount of CO being generated by each burner of the first plurality of burners for each location of the second plurality of locations. The controller is further configured to increase an A/F ratio of at least one burner of the second plurality of burners to increase A/F ratios at the second plurality of locations in order to decrease the CO levels at the second plurality of locations toward the threshold CO level, based on the amount of CO being generated by the at least one burner of the second plurality of burners.

An article of manufacture in accordance with another exemplary embodiment is provided. The article of manufacture includes a computer storage medium having a computer program encoded therein for adjusting CO emission levels within a boiler system. The boiler system has a first plurality of burners and a plurality of CO sensors disposed therein. The computer storage medium includes code for receiving a plurality of signals from the plurality of CO sensors disposed at a first plurality of locations in the boiler system. The computer storage medium further includes code for determining a plurality of CO levels at the first plurality of locations based on the plurality of signals. The computer storage medium further includes code for determining a second plurality of locations that have CO levels greater than or equal to a threshold CO level. The second plurality of locations is a subset of the first plurality of locations. The computer storage medium further includes code for determining a second plurality of burners in the boiler system that are contributing to the second plurality of locations having CO levels greater than or equal to the threshold CO level. The second plurality of burners is a subset of the first plurality of burners. The computer storage medium further includes code for determining an amount of CO being generated by each burner of the first plurality of burners for each location of the second plurality of locations. The computer storage medium further includes code for increasing an A/F ratio of at least one burner of the second plurality of burners to increase A/F ratios at the second plurality of locations in order to decrease the CO levels at the second plurality of locations toward the threshold CO level, based on the amount of CO being generated by the at least one burner of the second plurality of burners.

Other systems and/or methods according to the embodiments will become or are apparent to one with skill in the art upon review of the following drawings and detailed description. It is intended that all such additional systems and methods be within the scope of the present invention, and be protected by the accompanying claims.

DETAILED DESCRIPTION OF THE INVENTION

Figure 1:
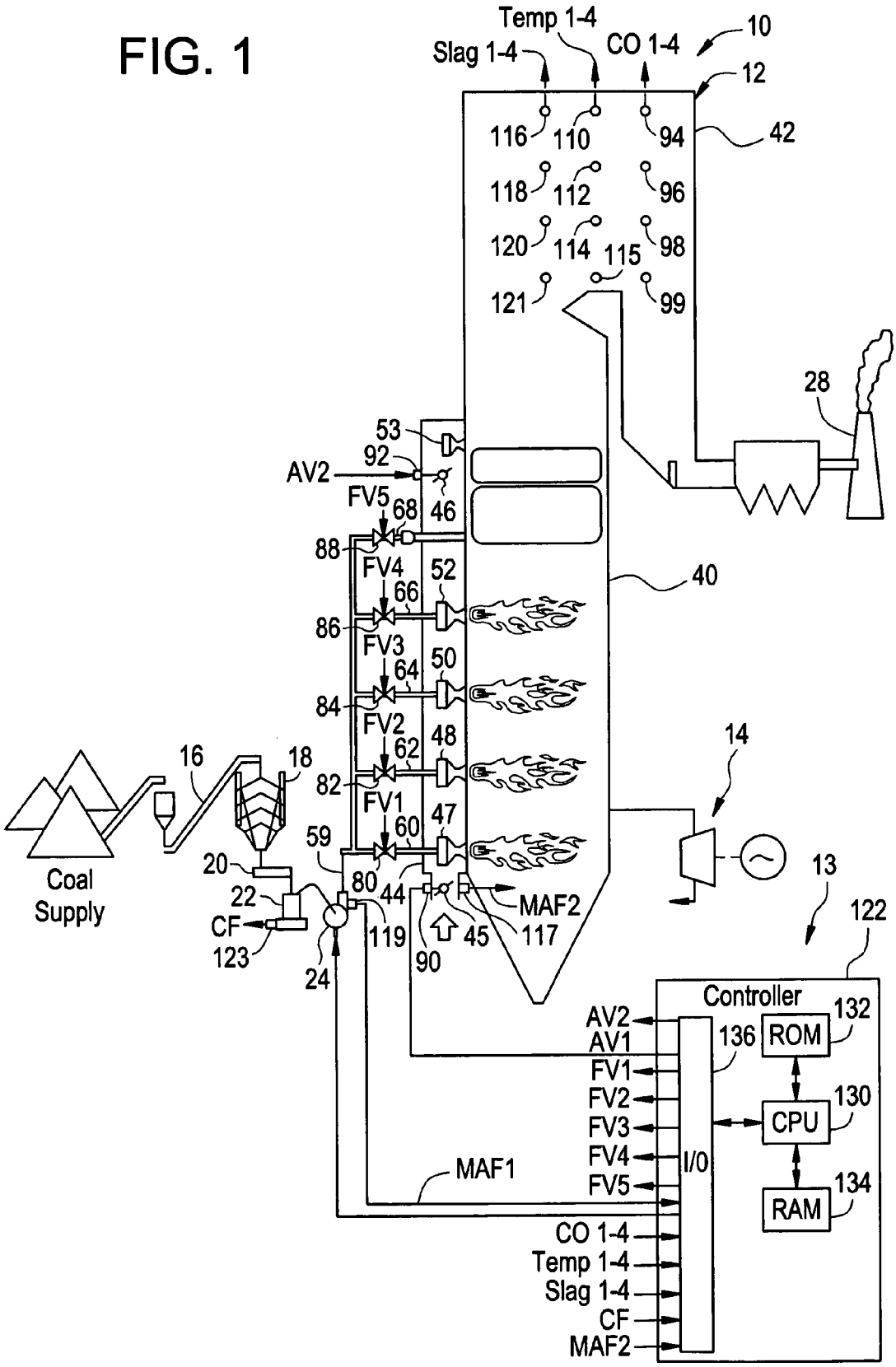
FIG. 1 illustrates a power generation system having a boiler system and a control system in accordance with an exemplary embodiment.

Referring to FIG. 1, a power generation system 10 for generating electrical power is illustrated. The power generation system 10 includes a boiler system 12, a control system 13, a turbine generator 14, a conveyor 16, a silo 18, a coal feeder 20, a coal pulverizer 22, an air source 24, and a smokestack 28.

The boiler system 12 is provided to burn an air-coal mixture to heat water to generate steam therefrom. The steam is utilized to drive the turbine generator 14, which generates electricity. It should be noted that in an alternative embodiment, the boiler system 12 could utilize other types of fuels, instead of coal, to heat water to generate steam therefrom. For example, the boiler system 12 could utilize any conventional type of hydrocarbon fuel such as gasoline, diesel fuel, oil, natural gas, propane, or the like. The boiler system 12 includes a furnace 40 coupled to a back path portion 42, an air intake manifold 44, burners 47, 48, 50, 52, an air port 53, and conduits 59, 60, 62, 64, 66, 68.

The furnace 40 defines a region where the air-coal mixture is burned and steam is generated. The back path portion 42 is coupled to the furnace 40 and receives exhaust gases from the furnace 40. The back pass portion 42 transfers the exhaust gases from the furnace 40 to the smokestack 28.

Figure 7:
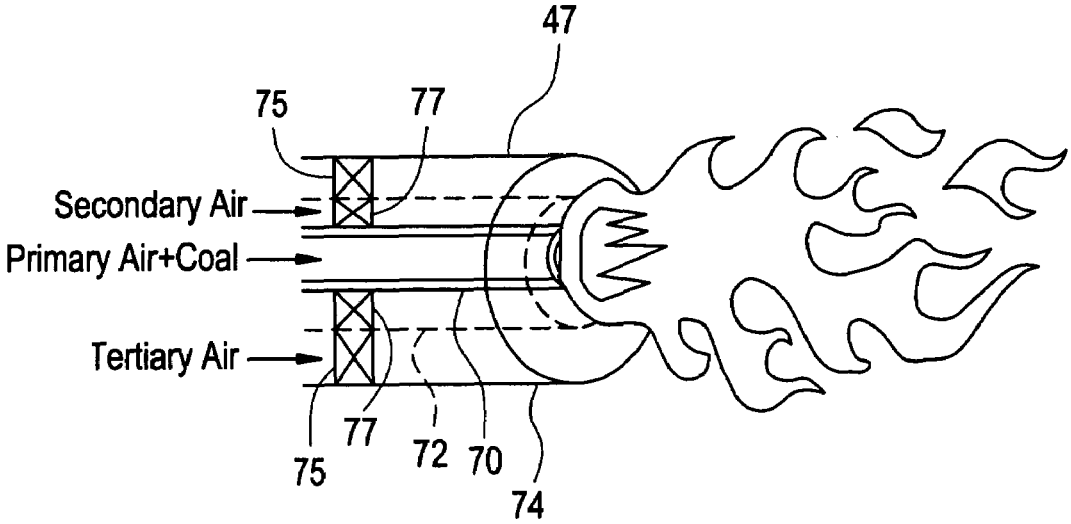
FIG. 7 is a schematic of a burner utilized in the boiler system of FIG. 1.

The air intake manifold 44 is coupled to the furnace 40 and provides a predetermined amount of secondary air to the burners 47, 48, 50, 52 and air port 53 utilizing the throttle valves 45, 46. Further, the burners 47, 48, 50, 52 receive an air-coal mixture from the air source 24 via the conduits 60, 62, 64, 66, respectively. The burners 47, 48, 50, 52 and air port 53 are disposed through apertures in the furnace 40. The burners 47, 48, 50, 52 emit flames into an interior region of the furnace 40 to heat water. Because the burners 47, 48, 50, 52 have a substantially similar structure, only a detailed explanation of the structure of the burner 47 will be provided. Referring to FIG. 7, the burner 47 has concentrically disposed tubes 70, 72, 74. The tube 70 receives the primary air-coal mixture (air-fuel mixture)from the conduit 60. The conduit 72 is disposed around the conduit 70 and receives secondary air from the air intake manifold 44. The conduit 74 is disposed around the conduit 72 and receives tertiary air also from the air intake manifold 44. The total air-coal mixture supplied to the burner 47 is ignited at an outlet port of the burner 47 and burned in the furnace. The burner 47 further includes a valve 75 disposed in the flow path between the tube 70 and the tube 72. An operational position of the valve 75 can be operably controlled by the controller 122 to control an amount of tertiary air being received by the burner 47. Further, the burner 47 further includes a valve 77 disposed in the flow path between the tube 72 and the tube 74. An operational position of the valve 77 can be operably controlled by the controller 122 to control an amount of secondary air being received by the burner 47.

Referring to FIG. 1, the control system 13 is provided to control an amount of air and coal received by the burners 47, 48, 50, 52 and air received by the air port 53. In particular, the control system 13 is provided to control A/F ratios and air-fuel mass flows at the burners 47, 48, 50, 52 and air injection port 53 to control CO levels, temperature levels, and a rate of slag formation at predetermined locations in the boiler system 12. The control system 13 includes electrically controlled primary air and coil valves 80, 82, 84, 86, 88, a combustion air actuator 90, an overfire air actuator 92, CO sensors 94, 96, 98, 99, temperature sensors 110, 112, 114, 115, slag detection sensors 116, 118, 120, 121, mass air flow sensors 117, 119, a coal flow sensor 123, and a controller 122. It should be noted that for purposes of discussion, it is presumed that the CO sensor 94, the temperature sensor 110, and the slag detection sensor 116 are disposed substantially at a first location within the boiler system 12. Further, the CO sensor 96, the temperature sensor 112, the slag detection sensor 118 are disposed substantially at a second location within the boiler system 12. Further, the CO sensor 98, the temperature sensor 114, the slag detection sensor 120 are disposed substantially at a third location within the boiler system 12. Still further, the CO sensor 99, the temperature sensor 115, and the slag detection sensor 121 are disposed substantially at a fourth location with the boiler system 12. Of course, it should be noted that in alternative embodiments the CO sensors, temperature sensors, and slag detection sensors can be disposed in different locations with respect to one another. Further, in an alternate embodiment, the CO sensors 94, 96, 98, 99 are disposed away from the first, second, third, and fourth locations respectively in the boiler system 12 and the CO levels at the first, second, third and fourth locations are estimated from the signals of CO sensors 94, 96, 98, 99, respectively, utilizing computational fluid dynamic techniques known to those skilled in the art. Further, in an alternate embodiment, the temperature sensors 110, 112, 114, 115 are disposed away from the first, second, third, and fourth locations, respectively, and the temperature levels at the first, second, third, and fourth locations are estimated from the signals of temperature sensors 110, 112, 114, 115, respectively utilizing computational fluid dynamic techniques known to those skilled in the art. Further, in an alternate embodiment, the slag detection sensors 116, 118, 120, 121 are disposed away from the first, second, third, and fourth locations, respectively, and the slag thickness levels are estimated from the signals of the slag detection sensors 116, 118, 120, 121, respectively, utilizing computational fluid dynamic techniques known to those skilled in the art.

The electrically controlled valves 80, 82, 84, 86, 88 are provided to control an amount of primary air or transport air delivered to the burners 47, 48, 50, 52 and conduit 68, respectively, in response to control signals (FV1), (FV2), (FV3), (FV4), (FV5), respectively, received from the controller 122. The primary air carries coal particles to the burners.

The actuator 90 is provided to control an operational position of the throttle valve 45 in the air intake manifold 44 for adjusting an amount of combustion air provided to the burners 47, 48, 50, 52, in response to a control signal (AV1) received from the controller 122.

The actuator 92 is provided to control an operational position of the throttle valve 46 for adjusting an amount of overfire air provided to the air port 53, in response to a control signal (AV2) received from the controller 122.

The CO sensors 94, 96, 98, 99 are provided to generate signals (C01), (C02), (C03), (C04) indicative of CO levels at the first, second, third, and fourth locations, respectively, within the boiler system 12. It should be noted that in an alternative embodiment, the number of CO sensors within the boiler system 12 can be greater than four CO sensors. For example, in an alternative embodiment, a bank of CO sensors can be disposed within the boiler system 12. As shown, the CO sensors 94, 96, 98, 99 are disposed in the back pass portion 42 of the boiler system 12. It should be noted that in an alternative embodiment, the CO sensors can be disposed in a plurality of other positions within the boiler system 12. For example, the CO sensors can be disposed at an exit plane of the boiler system 12.

The temperature sensors 110, 112, 114, 115 are provided to generate signals (TEMP1), (TEMP2), (TEMP3), (TEMP4) indicative of temperature levels at the first, second, third and fourth locations, respectively, within the boiler system 12. It should be noted that in an alternative embodiment, the number of temperature sensors within the boiler system 12 can be greater than four temperature sensors. For example, in an alternative embodiment, a bank of temperature sensors can be disposed within the boiler system 12. As shown, the temperature sensors 110, 112, 114, 115 are disposed in the furnace exit plane portion 42 of the boiler system 12. It should be noted that in an alternative embodiment, the temperature sensors can be disposed in a plurality of other positions within the boiler system 12. For example, the temperature sensors can be disposed at an exit plane of the boiler system 12.

The slag detection sensors 116, 118, 120, 121 are provided to generate signals (SLAG1), (SLAG2), (SLAG3), (SLAG4) indicative of slag thicknesses at the first, second, third, and fourth locations, respectively, within the boiler system 12. It should be noted that in an alternative embodiment, the number of slag detection sensors within the boiler system 12 can be greater than four slag detection sensors. For example, in an alternative embodiment, a bank of slag detection sensors can be disposed within the boiler system 12. As shown, the slag detection sensors 116, 118, 120, 121 are disposed in the back path portion 42 of the boiler system 12. It should be noted that in an alternative embodiment, the slag detection sensors can be disposed in a plurality of other positions within the boiler system 12. For example, the slag detection sensors can be disposed at an exit plane of the boiler system 12.

The mass flow sensor 119 is provided to generate a (MAF1) signal indicative of an amount of primary air being supplied to the conduit 59, that is received by the controller 122.

The mass flow sensor 117 is provided to generate a (MAF2) signal indicative of an amount of combustion air being supplied to the intake manifold 44 and the burners and air ports, that is received by the controller 122.

The coal flow sensor 123 is provided to generate a (CF) signal indicative of an amount of coal being supplied to the conduit 59, that is received by the controller 122.

The controller 122 is provided to generate control signals to control operational positions of the valves 80, 82, 84, 86, 88 and actuators 90, 92 for obtaining a desired A/F ratio at the burners 47, 48, 50, 52. Further, the controller 122 is provided to receive signals (CO1-CO4) from the CO sensors 94, 96, 98, 99 indicative of CO levels at the first, second, third and fourth locations and to determine the CO levels therefrom. Further, the controller 122 is provided to receive signals (TEMP1-TEMP4) from the temperature sensors 110, 112, 114, 115 indicative of temperature levels at the first, second, third, and fourth locations and to determine temperature levels therefrom. Still further, the controller 122 is provided to receive signals (SLAG1-SLAG4) from the slag detection sensors 116, 118, 120, 121 indicative of slag thicknesses at the first, second, third, and fourth locations and to determine slag thicknesses therefrom. The controller 122 includes a central processing unit (CPU) 130, a read-only memory (ROM) 132, a random access memory (RAM) 134, and an input-output (I/O) interface 136. Of course any other conventional types of computer storage media could be utilized including flash memory or the like, for example. The CPU 30 executes the software algorithms stored in at least one of the ROM 132 and the RAM 134 for implementing the control methodology described below.

Figure 2:
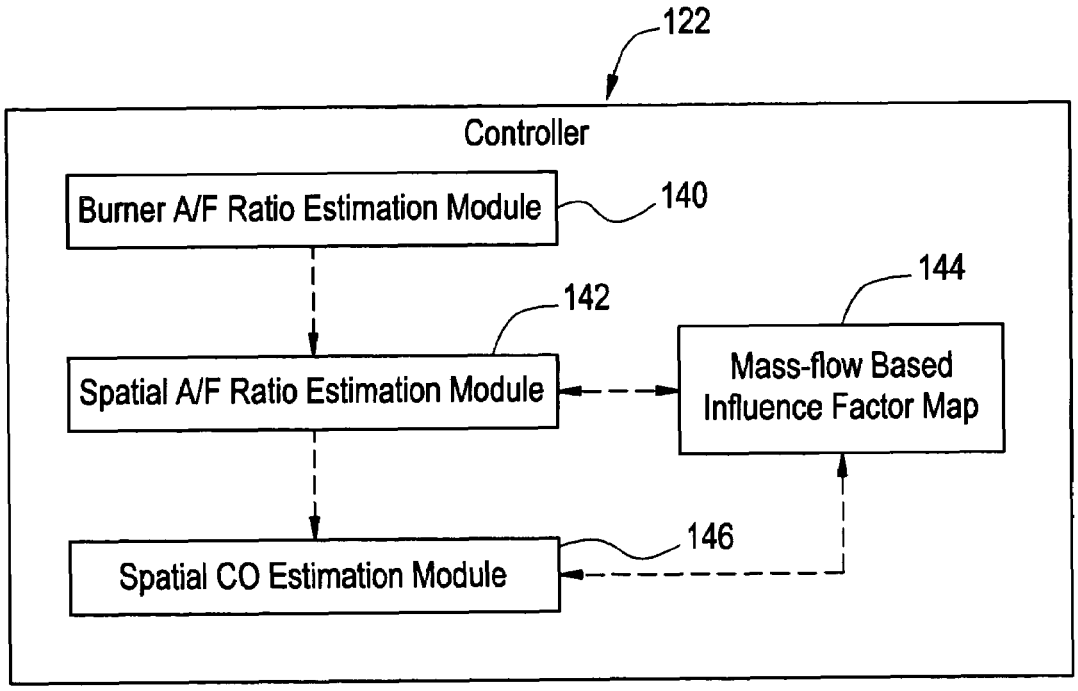
FIG. 2 is a block diagram of software algorithms utilized in the control system of FIG. 1.

Referring to FIG. 2, a block diagram of the software algorithms executed by the controller 122 is illustrated. In particular, the software algorithms include a burner A/F ratio estimation module 140, a spatial A/F ratio estimation module 142, a mass flow based influence factor map 144, and a spatial CO estimation module 146.

The burner A/F ratio estimation module 140 is provided to calculate an A/F ratio at each of the burners 47, 48, 50, 52. In particular, the module 140 calculates the A/F ratio and each of the burners based upon the amount of primary air, secondary air, and tertiary air and coal being provided to be burners 47, 48, 50, 52 and an amount of coal being provided by the coal pulverizer 22.

The mass flow based influence factor map 144 comprises a table that correlates a mass flow amount of exhaust gases from each burner to each of the first, second, third, and fourth locations within the boiler system 12. The controller 122 can utilize the mass flow based influence factor map 144 to determine which burners are primarily affecting particular locations within the boiler system 12. In particular, the controller 122 can determine that a particular burner is primarily affecting a particular location within the boiler system 12 by determining that a mass flow value from the particular burner to the particular location is greater than a threshold mass flow value.

In an alternative embodiment, the mass flow based influence factor map 144 comprises a table that indicates a percentage value indicating a percentage of the mass flow from each burner that flows to each of the first, second, third, and fourth locations. The controller 122 can determine that a particular burner is primarily affecting a particular location within the boiler system 12 by determining that a percentage value associated with a particular burner and a particular location is greater than a threshold percentage value. For example, the table could indicate that 10% of the mass flow at the first location is from the burner 47. If the threshold percentage value is 5%, then the controller 122 would determine burner 47 is primarily affecting the mass flow at the first location.

The mass flow based influence factor map 144 can be determined using isothermal physical models and fluid dynamic scaling techniques of the boiler system 12 or computational fluid dynamic models of the boiler system 12.

The spatial A/F ratio estimation model 142 is provided to calculate an A/F ratio at each of the first, second, third, and fourth locations in the boiler system 12. In particular, the module 142 utilizes the A/F ratios associated with each of the burners and the mass flow based influence factor map 144 to calculate an A/F ratio at each of the first, second, third, and fourth locations in the boiler system 12.

The spatial CO estimation model 142 is provided to calculate a CO level at each of the first, second, third, and fourth locations in the boiler system 12. In particular, the module 142 utilizes the A/F ratio at each of the first, second, third, and fourth locations to estimate the CO levels at the first, second, third, and fourth locations.

Figure 3:
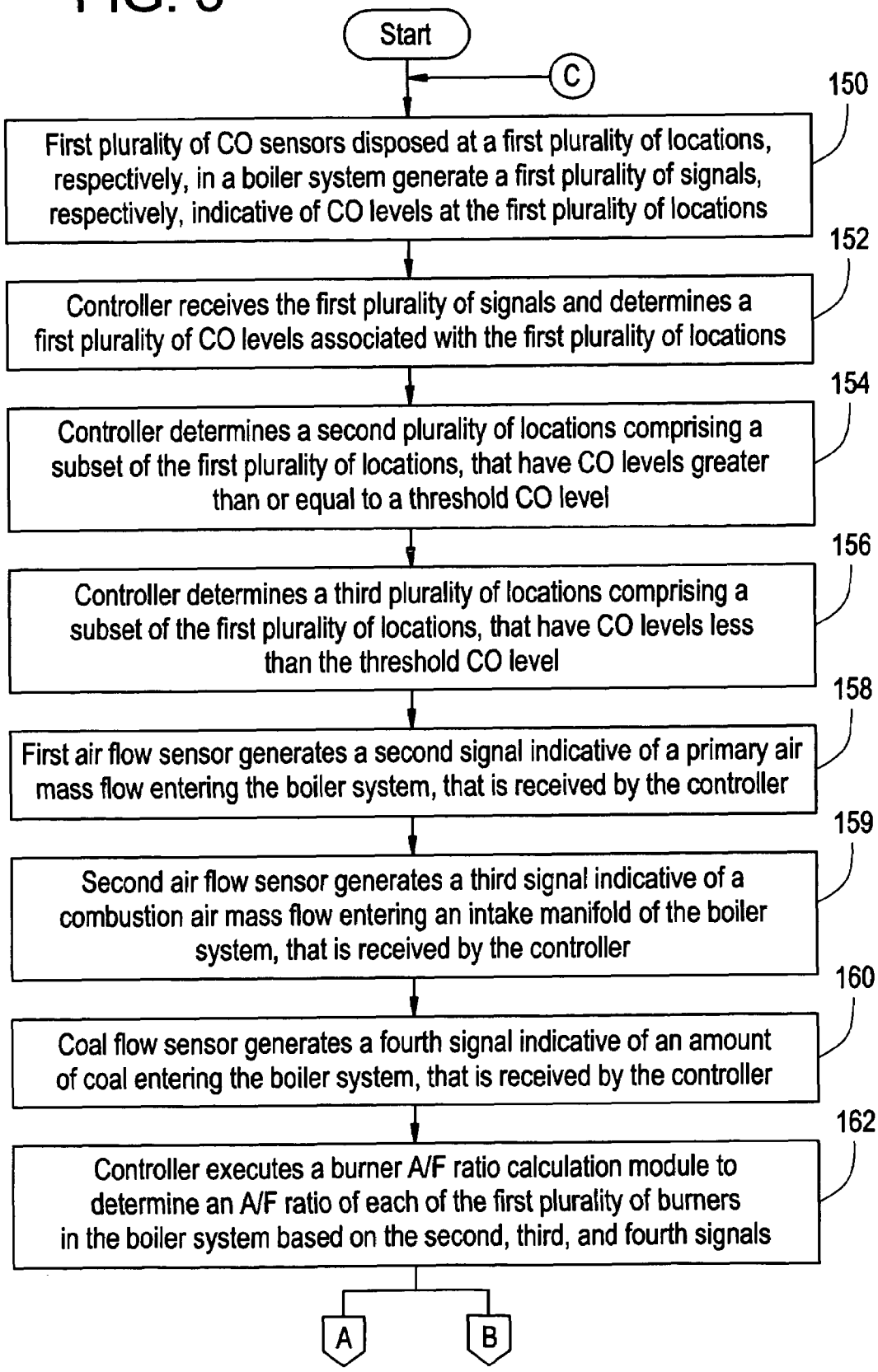
FIGS. 3-5 are flowcharts of a method for adjusting CO levels in predetermined locations of the boiler system of FIG. 1.
Figure 4:
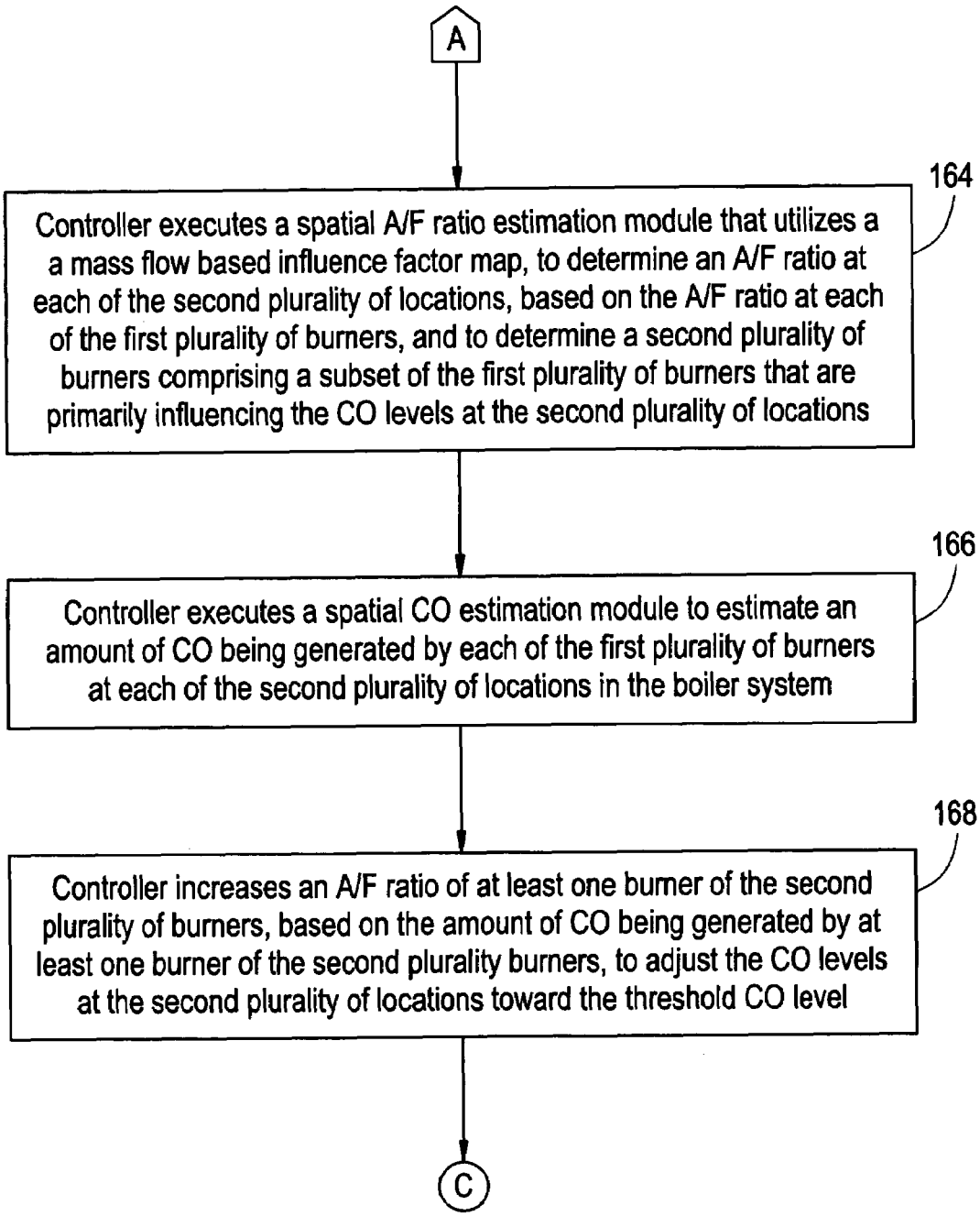
Figure 5:
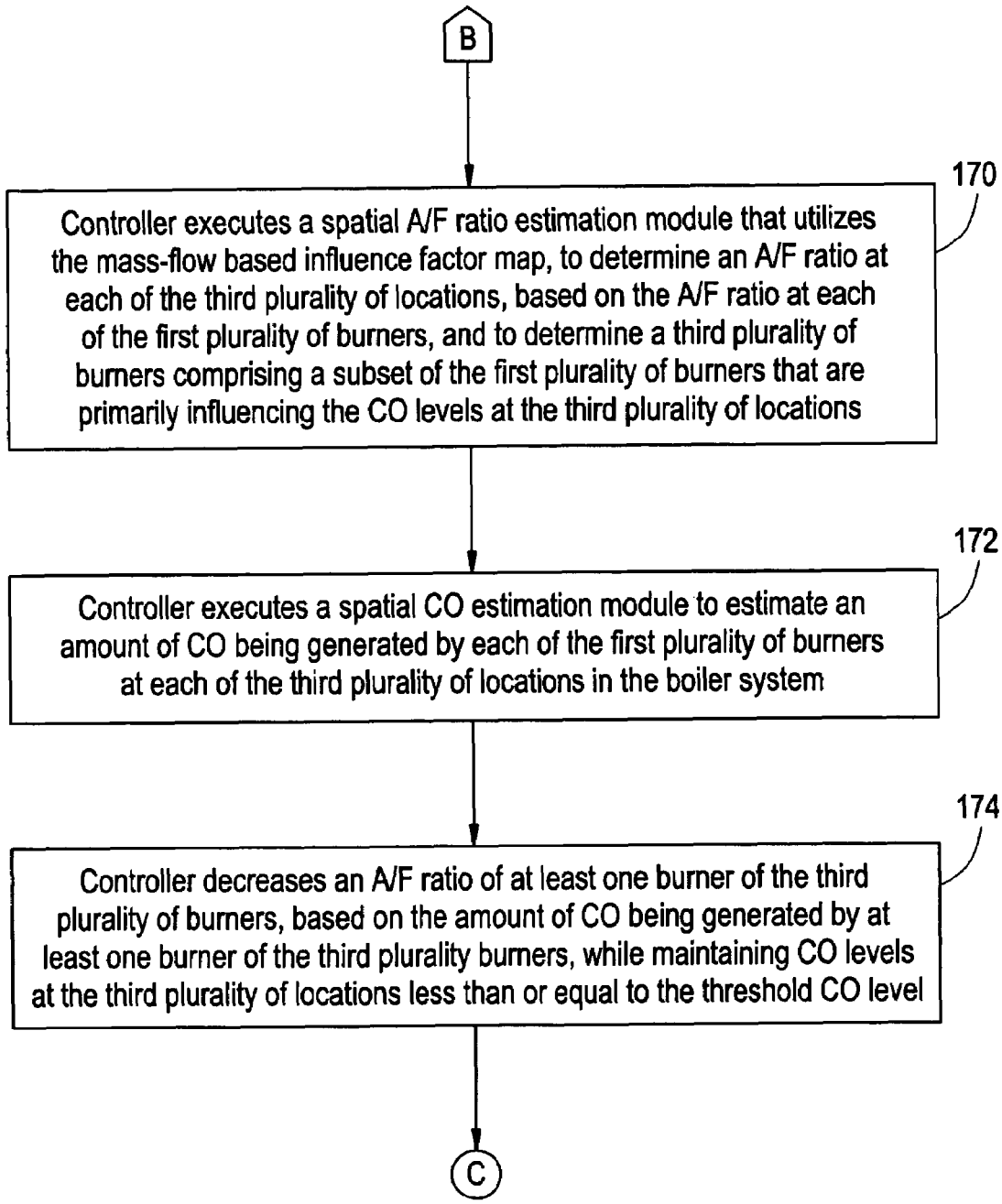

Referring to FIGS. 3-5, a method for adjusting CO levels in the boiler system 12 will now be explained. The method can be implemented utilizing software algorithms executed by the controller 122.

At step 150, a first plurality of CO sensors disposed at a first plurality of locations, respectively, in a boiler system 12 generate a first plurality of signals, respectively, indicative of CO levels at the first plurality of locations. For example, the CO sensors 94, 96, 98, 99 can generate signals (CO1), (C02), (C03), (C04) respectively, indicative of CO levels at the first, second, third, and fourth locations, respectively.

At step 152, the controller 122 receives the first plurality of signals and determines a first plurality of CO levels associated with the first plurality of locations. For example, the controller 122 can receive the signals (CO1), (C02), (C03), (C04) and determine CO levels associated with the first, second, third, and fourth locations, respectively.

At step 154, the controller 122 determines a second plurality of locations comprising a subset of the first plurality of locations, that have CO levels greater than or equal to a threshold CO level. For example, the controller 122 can determine that the first and second locations have CO levels greater than or equal to the threshold CO level.

At step 156, the controller 122 determines a third plurality of locations comprising a subset of the first plurality of locations, that have CO levels less than the threshold CO level. For example, the controller 122 can determine that the third and fourth locations have CO levels less than the threshold CO level.

At step 158, the air flow sensor 119 generates the (MAFI) signal indicative of a primary air mass flow entering the boiler system 12, that is received by the controller 122.

At step 159, the air flow sensor 117 generates the (MAF2) signal indicative of a combustion air mass flow entering the intake manifold 44, that is received by the controller. The combustion air mass flow comprises the secondary air and tertiary air received by the burners and the overfire air received by the air port 53.

At step 160, the coal flow sensor 123 generates the (CF) signal indicative of an amount of coal (e.g., total mill coal flow) entering the boiler system 12, that is received by the controller 122. Of course, in an alternate embodiment, the amount of coal being received by each burner can be calculated or monitored using coal flow sensors.

At step 162, the controller 122 executes the burner A/F ratio calculation module 140 to determine an A/F ratio of each of the first plurality of burners in the boiler system 122 based on the (MAFI) signal, the (MAF2) signal, and the (CF) signal. For example, the controller 122 can execute the burner A/F ratio calculation module 140 to determine A/F ratios for the burners 47, 48, 50, 52 based on the (MAFI) signal, the (MAF2) signal, and the (CF) signal. After step 162, the controller 122 substantially simultaneously executes both sets of steps 164-168 and steps 170-174.

Referring to FIG. 4, the steps 164-168 will now be explained. At step 164, the controller 122 executes the spatial A/F ratio estimation module 142 that utilizes a mass flow based influence factor map 144, to determine an A/F ratio at each of the second plurality of locations, based on the A/F ratio at each of the first plurality of burners, and to determine a second plurality of burners comprising a subset of the first plurality of burners that are primarily influencing the CO levels at the second plurality of locations. For example, the controller 122 can execute the module 142 the utilizes the mass flow based influence factor map 144 to determine A/F ratios at the first and second locations, based on the A/F ratio at each of the burners 47, 48, 50, 52. Further, for example, the controller 122 can determine that the burners 47, 48 are primarily influencing the CO levels at the first and second locations in the boiler system 12. After step 164, the method advances to step 166.

At step 166, the controller 122 executes a spatial CO estimation module 146 to estimate an amount of CO being generated by each of the first plurality of burners at each of the second plurality of locations in the boiler system 12. For example, the controller 122 can execute the module 146 to estimate an amount of CO being generated by the burners 47, 48, 50, 52 at the first and second locations in the boiler system 12. After step 166, the method advances to step 168.

Figure 6:
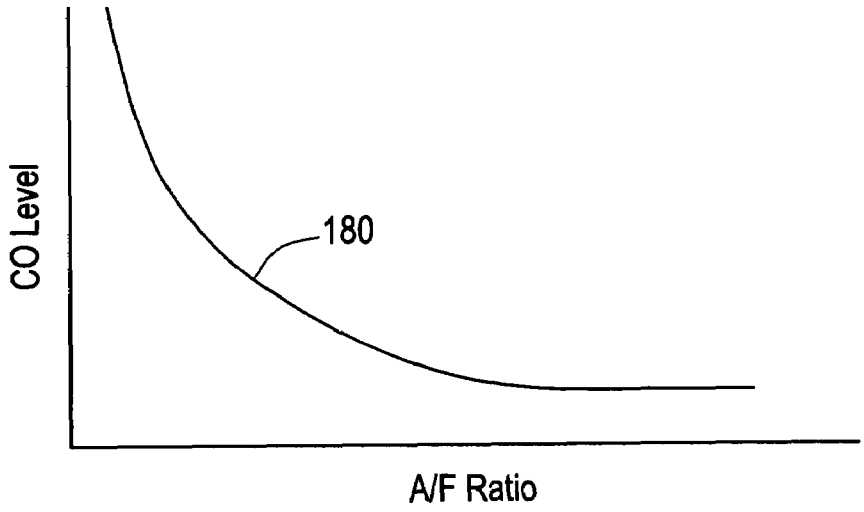
FIG. 6 is a schematic of mapped values utilized by the control system of FIG. 1 for controlling burner A/F ratio values based on CO levels in the boiler system.

At step 168, the controller 122 increases an A/F ratio of at least one burner of the second plurality of burners, based on the amount of CO being generated by at least one burner of the second plurality burners, to adjust the CO levels at the second plurality of locations toward the threshold CO level. For example, the controller 122 can increase an A/F ratio of at least one of the burners 47, 48, based on the amount of CO being generated by at least one of burners 47, 48, to adjust CO levels at first and second locations toward the threshold CO level by increasing a fuel mass-flow into at least one of burners 47, 48 while maintaining or decreasing an air mass-flow to the at least one of burners 47, 48. Referring to FIG. 6, the controller 122 can utilize a table or transfer function illustrated by the waveform 180 to determine a desired A/F ratio or an A/F ratio adjustment value for the burners 47, 48 based on a measured CO level. After step 168, the method returns to step 150.

Referring to FIG. 5, the steps 170-174 will now be explained. At step 170, the controller 122 executes the spatial A/F ratio estimation module 142 that utilizes the mass-flow based influence factor map 144, to determine an A/F ratio at each of the third plurality of locations, based on the A/F ratio at each of the first plurality of burners, and to determine a third plurality of burners comprising a subset of the first plurality of burners that are primarily influencing the CO levels at the third plurality of locations. For example, the controller 122 can execute the module 142 the utilizes the mass flow based influence factor map 144 to determine A/F ratios at the third and fourth locations, based on the A/F ratio at each of the burners 47, 48, 50, 52. Further, for example, the controller 122 can determine that the burners 50, 52 are primarily influencing the CO levels at the third and fourth locations in the boiler system 12. After step 170, the method advances to step 172.

At step 172, the controller executes the spatial CO estimation module 146 to estimate an amount of CO being generated by each of the first plurality of burners at each of the third plurality of locations in the boiler system 12. For example, the controller 122 can execute the module 146 to estimate an amount of CO being generated by the burners 47, 48, 50, 52 at the third and fourth locations in the boiler system 12. After step 172, the method advances to step 174.

At step 174, the controller 122 decreases an A/F ratio of at least one burner of the third plurality of burners, based on the amount of CO being generated by at least one burner of the third plurality burners, while maintaining CO levels at the third plurality of locations less than or equal to the threshold CO level. For example, the controller 122 can decrease an A/F ratio of at least one of the burners 50, 52, based on the amount of CO being generated by at least one of burners 50, 52, while maintaining CO levels at the third and fourth locations less than or equal to the threshold CO level by increasing a fuel mass-flow into at least one of the burners 50, 52 while maintaining or decreasing an air mass-flow to the at least one of burners 50, 52. Referring to FIG. 6, the controller 122 can utilize a table or transfer function illustrated by the waveform 180 to determine a desired A/F ratio or an A/F ratio adjustment value for the burners 50, 52 based on a measured CO level. After step 174, the method returns to step 150.

The inventive system, method, and article of manufacture for adjusting CO levels provide a substantial advantage over other system and methods. In particular, these embodiments provide a technical effect of adjusting A/F ratios at burners to decrease CO levels at predetermined locations in a boiler system that are greater than a threshold CO level to improve outputted CO emission levels.

The above-described methods can be embodied in the form of computer program code containing instructions embodied in tangible media, such as floppy diskettes, CD ROMs, hard drives, or any other computer-readable storage medium, wherein, when the computer program code is loaded into and executed by a computer, the computer becomes an apparatus for practicing the invention.

While the invention is described with reference to an exemplary embodiment, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited to the embodiment disclosed for carrying out this invention, but that the invention includes all embodiments falling with the scope of the intended claims. Moreover, the use of the term's first, second, etc. does not denote any order of importance, but rather the term's first, second, etc. are used to distinguish one element from another.

What is claimed is:

1. A method for adjusting carbon monoxide (CO) emission levels in a boiler system comprising:

receiving a first CO level of a first location and a second CO level of a second location;

receiving a mass-flow based influence factor map having a first mass flow value indicating a mass flow value of gas emitted from a first burner flowing in the first location, a second mass flow value indicating a mass flow value of gas emitted from a second burner flowing in the first location, a third mass flow value indicating a mass flow value of gas emitted from the first burner flowing in the second location, and a fourth mass flow value indicating a mass flow value of gas emitted from a second burner flowing in the second location;

determining whether the first CO level is greater than a threshold CO level;

comparing the first mass flow value and the second mass flow value to determine which burner primarily influences mass flow in the first location responsive to determining that the first CO level is greater than the threshold CO level; and adjusting an air fuel ratio of the burner that primarily influences mass flow in the first location responsive to determining which burner primarily influences mass flow in the first location.

2. The method of claim 1, wherein the method further includes:

determining whether the second CO level is less than the threshold CO level;

comparing the third mass flow value and the fourth mass flow value to determine which burner primarily influences mass flow in the second location responsive to determining that the second CO level is greater than the threshold CO level; and adjusting an air fuel ratio of the burner that primarily influences mass flow in the second location responsive to determining which burner primarily influences mass flow in the second location.

3. The method of claim 1, wherein adjusting an air fuel ratio of the burner that primarily influences mass flow in the first location includes increasing an air fuel ratio of the burner that primarily influences mass flow in the first location.

4. The method of claim 2, wherein adjusting an air fuel ratio of the burner that primarily influences mass flow in the second location includes increasing an air fuel ratio of the burner that primarily influences mass flow in the second location.

5. The method of claim 1, wherein adjusting an air fuel ratio of the burner that primarily influences mass flow in the first location includes decreasing an air fuel ratio of the burner that primarily influences mass flow in the first location.

6. The method of claim 2, wherein adjusting an air fuel ratio of the burner that primarily influences mass flow in the second location includes decreasing an air fuel ratio of the burner that primarily influences mass flow in the second location.

7. The method of claim 1, wherein the first mass flow value is defined as a percentage of gas emitted from a first burner flowing in the first location.

8. The method of claim 1, wherein the first mass flow value is defined as an amount of gas emitted from a first burner flowing in the first location.

9. A system for adjusting carbon monoxide (CO) emission levels in a boiler comprising:

a first sensor operative to sense a first CO level of a first location;

a second sensor operative to sense a second CO level of a second location; and a controller operative to receive the first CO level from the first sensor, receive the second CO level from the second sensor, receive a mass-flow based influence factor map having a first mass flow value indicating a mass flow value of gas emitted from a first burner flowing in the first location, a second mass flow value indicating a mass flow value of gas emitted from a second burner flowing in the first location, a third mass flow value indicating a mass flow value of gas emitted from the first burner flowing in the second location, and a fourth mass flow value indicating a mass flow value of gas emitted from a second burner flowing in the second location, determine whether the first CO level is greater than a threshold CO level, compare the first mass flow value and the second mass flow value to determine which burner primarily influences mass flow in the first location responsive to determining that the first CO level is greater than the threshold CO level, and adjust an air fuel ratio of the burner that primarily influences mass flow in the first location responsive to determining which burner primarily influences mass flow in the first location.

10. The system of claim 9, wherein the controller is further operative to determine whether the second CO level is greater than the threshold CO level, compare the third mass flow value and the fourth mass flow value to determine which burner primarily influences mass flow in the second location responsive to determining that the second CO level is less than the threshold CO level, and adjust an air fuel ratio of the burner that primarily influences mass flow in the second location responsive to determining which burner primarily influences mass flow in the second location.

11. The system of claim 9, wherein adjusting an air fuel ratio of the burner that primarily influences mass flow in the first location includes increasing an air fuel ratio of the burner that primarily influences mass flow in the first location.

12. The system of claim 10, wherein adjusting an air fuel ratio of the burner that primarily influences mass flow in the second location includes increasing an air fuel ratio of the burner that primarily influences mass flow in the second location.

13. The system of claim 9, wherein adjusting an air fuel ratio of the burner that primarily influences mass flow in the first location includes decreasing an air fuel ratio of the burner that primarily influences mass flow in the first location.

14. The system of claim 10, wherein adjusting an air fuel ratio of the burner that primarily influences mass flow in the second location includes decreasing an air fuel ratio of the burner that primarily influences mass flow in the second location.

* * * * *